US008840438B2

(12) United States Patent
Broughton et al.

(10) Patent No.: US 8,840,438 B2
(45) Date of Patent: Sep. 23, 2014

(54) HYDRAULIC SYSTEM FOR A WATERCRAFT

(75) Inventors: George Broughton, Wadsworth, IL (US); Darrell Albert Wiatrowski, Libertyville, IL (US)

(73) Assignee: BRP US Inc., Sturtevant, WI (US)

( * ) Notice: Subject to any disclaimer, the term of this patent is extended or adjusted under 35 U.S.C. 154(b) by 134 days.

(21) Appl. No.: 13/333,108

(22) Filed: Dec. 21, 2011

(65) Prior Publication Data

US 2012/0204776 A1 Aug. 16, 2012

Related U.S. Application Data

(60) Provisional application No. 61/426,194, filed on Dec. 22, 2010.

(51) Int. Cl.

| | |
|---|---|
| ***B63H 20/08*** | (2006.01) |
| ***F15B 21/04*** | (2006.01) |
| ***B63H 25/22*** | (2006.01) |
| ***F15B 11/17*** | (2006.01) |
| ***B63H 21/38*** | (2006.01) |
| ***B63H 20/00*** | (2006.01) |
| ***F15B 21/00*** | (2006.01) |
| *B63J 3/00* | (2006.01) |
| *B63H 20/12* | (2006.01) |
| *B63H 20/10* | (2006.01) |

(52) U.S. Cl.

CPC ..... *B63H 25/22* (2013.01); *F15B 2211/20561* (2013.01); *F15B 2211/20538* (2013.01); *F15B 2211/27* (2013.01); *F15B 21/044* (2013.01); *B63J 2003/006* (2013.01); *B63H 20/12* (2013.01); *F15B 11/17* (2013.01); *B63H 21/38* (2013.01); *B63H 20/001* (2013.01); *F15B 21/005* (2013.01); *B63H 20/10* (2013.01); *F15B 2211/20576* (2013.01)

USPC ..... 440/61 S

(58) Field of Classification Search

USPC ..... 440/61 S, 61 H, 61 G, 61 R

IPC ..... B63H 20/12

See application file for complete search history.

(56) References Cited

U.S. PATENT DOCUMENTS

| | | | |
|---|---|---|---|
| 1,806,136 | A | 5/1931 | Weiss |
| 3,958,420 | A | 5/1976 | Yokota |
| 4,449,470 | A | 5/1984 | Rump |
| 4,551,105 | A | 11/1985 | Hall |
| RE33,043 | E | 9/1989 | McBeth |
| 5,350,223 | A | 9/1994 | Stewart, Jr. |
| 5,503,098 | A | 4/1996 | Bohlin |
| 5,649,746 | A | 7/1997 | Stewart, Jr. |

(Continued)

FOREIGN PATENT DOCUMENTS

| | | | |
|---|---|---|---|
| EP | 1331405 | A1 | 7/2003 |
| GB | 2283718 | A | 5/1995 |
| WO | 2007090943 | A1 | 8/2007 |
| WO | 2008118086 | A1 | 10/2008 |

*Primary Examiner* — Stephen Avila

(74) *Attorney, Agent, or Firm* — BCF LLP

(57) ABSTRACT

An independent hydraulic system for operating at least one first system used in the operation of a watercraft and adapted to be fluidly connected to one other independent hydraulic system for operating at least one second system used in the operation of the watercraft, so that actuating a driving actuator part of the independent hydraulic system, causes a flow of fluid to flow from the independent hydraulic system to the other independent hydraulic system.

12 Claims, 11 Drawing Sheets

(56) References Cited

U.S. PATENT DOCUMENTS

| | | | | |
|---|---|---|---|---|
| 5,687,566 | A | 11/1997 | Petty | |
| 5,727,390 | A | 3/1998 | Hartle | |
| 5,813,225 | A | 9/1998 | Petty | |
| 5,857,488 | A * | 1/1999 | Kobelt | 137/596 |
| 5,964,326 | A | 10/1999 | Lee et al. | |
| 6,079,206 | A | 6/2000 | Petrzik et al. | |
| 6,193,031 | B1 | 2/2001 | Baechle et al. | |
| 6,233,933 | B1 | 5/2001 | Petty | |
| 6,598,696 | B2 | 7/2003 | Lucking et al. | |
| 6,658,842 | B2 | 12/2003 | Yamasaki et al. | |
| 6,948,988 | B2 * | 9/2005 | Okabe | 440/61 R |
| 7,125,438 | B2 | 10/2006 | Skoglund et al. | |
| 7,364,482 | B1 * | 4/2008 | Wong et al. | 440/1 |
| 7,387,347 | B2 | 6/2008 | Jensen et al. | |
| 7,413,490 | B2 | 8/2008 | Tawa et al. | |

* cited by examiner 206
201
202
203
204
200
404
102
406
402
400
408
410
343
M
341
303
311
302
330
313
315
328
317
304
301
A
305
310
308a
307
308b
306b
306a
316
312
300
322
325
320
318
323
324
327
326
314
121
123
125
106

206
201
202
203
204
200
404
102
406
402
400
408
410
343
M
341
303
311
302
330
313
315
328
317
304
301
B
305
310
308a
307
308b
306b
306a
316
312
322
325
320
318
323
324
327
326
314
121
123
125
106
300

HYDRAULIC SYSTEM FOR A WATERCRAFT

CROSS-REFERENCE

The present application claims priority to U.S. Provisional Application No. 61/426,194, filed Dec. 22, 2010, the entirety of which is incorporated herein by reference.

FIELD OF THE INVENTION

The present invention relates generally to a hydraulic system for a watercraft.

BACKGROUND

The various types of watercraft currently commercialized include a wide range of different onboard independent hydraulic systems. These onboard independent hydraulic systems are part of the operational systems of the watercraft on which they are installed. They can be used in the operation of various systems of the watercraft, such as the watercraft steering system and the watercraft propulsion system, and any other device attached thereto and used thereon.

Steering systems found in watercraft, and more particularly motorized watercraft, are often operated via hydraulic systems. Such hydraulic systems usually include a driving hydraulic actuator, such as a manually operated pump, connected to the steering helm of the watercraft, a driven hydraulic actuator, such as a piston and cylinder assembly or a rotary hydraulic actuator, connected to the watercraft propulsion system, such as an outboard marine engine, a stern drive or a water jet propulsion system, and various conduits or hydraulic hoses, connecting the driving and driven hydraulic actuators. In these hydraulic systems, operation of the driving hydraulic actuator causes corresponding actuation of the driven hydraulic actuator thus steering the watercraft. A variety of such systems is well known in the art and examples can be found in U.S. Pat. Nos. 5,176,549; 5,266,060; 5,340,341; 5,447,456; and 6,790,110.

The operation of watercraft propulsion systems also often involves other hydraulic systems. For example, watercraft using outboard engines are often equipped with what is known in the art as "tilt/trim systems". As an example, a marine outboard engine generally has a stern bracket assembly that is fixed to the stern of the watercraft and to an outboard marine engine main unit incorporating an internal combustion engine, propeller and the like. The outboard marine engine is typically designed so that the steering angle and the tilt/trim angles of the outboard marine engine relative to the watercraft can be adjusted and modified as desired (as discussed above regarding the steering angle). The stern bracket assembly typically includes a swivel bracket carrying the outboard engine for pivotal movement about a steering axis, and a clamping bracket supporting the swivel bracket and the outboard engine for pivotal movement about a tilt axis extending generally horizontally.

Known tilt/trim systems typically comprise a tilt hydraulic cylinder unit for swinging the swivel bracket through a relatively large angle to lift the lower portion of the outboard marine engine above the water level or, conversely, lower this lower portion of the outboard marine engine below the water level. Such systems may further comprise a distinct trim hydraulic cylinder unit for angularly moving the swivel bracket through a relatively small angle to trim the outboard engine while the lower portion thereof is being submerged. Hydraulic tilt/trim systems are known in the art and examples of such systems can be found in U.S. Pat. Nos. 4,521,202; 5,176,093; 5,195,914; 5,505,641; 5,718,613; 5,816,872; 6,220,905; 6,607,410; 6,656,004; and 6,948,988.

A wide variety of other movable structures mounted to a watercraft exists. In many instances, such movable structures are operated via hydraulic systems. Examples of such movable structures operated through hydraulic systems include boat towers and various movable platforms like boarding bridges and platforms found at the rear of large yacht and used to get small watercraft such as personal watercraft out of the water when they are not used. U.S. Pat. Nos. 5,613,462; 6,474,256; 6,938,572; and 7,520,240; and US Patent Applications with Publications No. 2008/0156250A1; 2009/0235857A1; and 2010/0089302A1 show various examples of such movable structures operated through various hydraulic systems.

Maintenance of such onboard hydraulic systems require replacement of the fluid used therein, which involves the bleeding of the fluid already in the system, the filling thereof by new fluid, and the purging of gas (often just air) that may have entered the system. The purging of gas having entered any of those hydraulic systems, for example a hydraulic steering system, may be of particular importance for maintaining the watercraft in appropriate operation condition. A hydraulic steering system operating with less than the required level of fluid or with too much gas within the system will be less responsive and such presence of air in the system can be damaging for certain hydraulic systems. One example of a system that exists to fill/bleed/purge a hydraulic steering system is the Teleflex® SeaStar® Power Purge System Part No. HA5447.

However, maintenance of any onboard hydraulic system may be time consuming, inappropriately done (if done manually by some watercraft owner), costly and messy, which can be the case when oily hydraulic fluids have to be filled or bled within the watercraft, as is the case regarding most hydraulic steering systems when maintenance is performed using portable filling/bleeding/purging equipments operated on the watercraft's deck. Furthermore, such portable filling/bleeding/purging equipments are relatively expensive and are often owned by professionals of watercraft maintenance charging additional fees for doing the maintenance of a watercraft's onboard hydraulic systems.

In view of the above, there is a need for a system that would allow low cost, clean, quick, timely and simple filling, bleeding and/or purging of an independent hydraulic system for operating at least one second system used in the operation of the watercraft.

SUMMARY

It is an object of the present invention to ameliorate at least some of the inconveniences present in the prior art by providing a first independent hydraulic system for operation of at least one system used in the operation of a watercraft, for example a tilt/trim system, adapted to be fluidly connected to at least one second independent hydraulic system for operation of at least another system used in the operation of the watercraft, for example, a steering system. More particularly, once the two independent hydraulic systems are fluidly connected to each others, the first independent hydraulic system can be used to fill, bleed and/or purge the second independent hydraulic system.

In one aspect, an independent hydraulic system is provided, the independent hydraulic system operating at least one first system used in the operation of a watercraft. The watercraft comprises at least one other independent hydraulic system for operating at least one second system used in the operation of the watercraft. The at least one other independent hydraulic system comprises a first driving hydraulic actuator for directing fluid flow within the at least one other independent hydraulic system and at least one first driven hydraulic actuator for operation of the at least one second system used in the operation of the watercraft. The independent hydraulic system comprises a reservoir, a second driving hydraulic actuator fluidly connected to the reservoir for directing fluid flow within the independent hydraulic system, and at least one second driven hydraulic actuator fluidly connected to the second driving hydraulic actuator for operation of the at least one first system used in the operation of the watercraft. The independent hydraulic system is adapted to be fluidly connected to the at least one other independent hydraulic system. When the independent hydraulic system and the at least one other independent hydraulic system are fluidly connected to each other, actuating the second driving actuator causes a first flow of fluid to flow from the independent hydraulic system to the at least one other independent hydraulic system.

In a further aspect, a valve unit is fluidly connected to the second driving hydraulic actuator, and the valve unit is adapted to selectively fluidly connect the independent hydraulic system to the at least one other independent hydraulic system.

In an additional aspect, a first connector is in fluid connection with the second driving hydraulic actuator and is adapted to fluidly connect the independent hydraulic system to the at least one other independent hydraulic system. When the independent hydraulic system and the at least one other independent hydraulic system are fluidly connected to each other, the first flow enters the at least one other independent hydraulic system via the first connector.

In a further aspect, the at least one other independent hydraulic system has a second connector fluidly connected to the at least one first driven hydraulic actuator, and the first connector is adapted to fluidly connect the independent hydraulic system to the at least one other independent hydraulic system via the second connector. When the independent hydraulic system and the at least one other independent hydraulic system are fluidly connected to each other via the fluid connection of the first and second connectors, the first flow enters the at least one other independent hydraulic system via the first and second connectors.

In an additional aspect, a first connector is in fluid connection with the reservoir and is adapted to fluidly connect the reservoir to the at least one other independent hydraulic system. When the independent hydraulic system and the at least one other independent hydraulic system are fluidly connected to each other, actuating the second driving actuator causes a second flow of fluid to flow from the at least one other independent hydraulic system to the reservoir via the first connector.

In a further aspect, the at least one other independent hydraulic system has a second connector fluidly connected to the at least one first driven hydraulic actuator, and the first connector is adapted to fluidly connect the independent hydraulic system to the at least one other independent hydraulic system via the second connector. When the first and second connectors are fluidly connected to each other, actuating the second driving actuator causes a second flow of fluid to flow from the at least one other independent hydraulic system to the reservoir via the first and second connectors.

In an additional aspect, the at least one second system used in the operation of the watercraft is a steering system of the watercraft, and the independent hydraulic system further comprises a controller connected to the second driving hydraulic actuator for controlling the actuation of the second driving hydraulic actuator, the controller being positioned on the watercraft so as to be operated simultaneously with the steering system by a single operator.

In a further aspect, the watercraft has a propulsion system and the at least one first system used in the operation of the watercraft is one of a tilt system, a trim system and a combined tilt and trim system.

In an additional aspect, the independent hydraulic system further comprises a controller connected to the second driving hydraulic actuator for controlling the actuation of the second driving hydraulic actuator, and the controller is positioned on the watercraft so as to be operated by a single operator doing maintenance of the watercraft propulsion system.

In a further aspect, the propulsion system is one of an outboard marine engine and a jet propulsion system.

In an additional aspect, the at least one first system used in the operation of the watercraft is at least one of a combined tilt and trim system, a boat tower, and an actuated rear platform.

In another aspect, an independent hydraulic system is provided, the independent hydraulic system operating at least one first system used in the operation of a watercraft. The watercraft comprises at least one other independent hydraulic system for operating at least one second system used in the operation of the watercraft. The at least one other independent hydraulic system comprises a first driving hydraulic actuator for directing fluid flow within the at least one other independent hydraulic system and at least one first driven hydraulic actuator for operation of the at least one second system used in the operation of the watercraft. The independent hydraulic system comprises, a reservoir, a second driving hydraulic actuator fluidly connected to the reservoir for directing fluid flow within the independent hydraulic system, and at least one second driven hydraulic actuator fluidly connected to the second driving hydraulic actuator for operation of the at least one first system used in the operation of the watercraft. A valve unit is fluidly connected to the second driving hydraulic actuator, the valve unit being adapted to selectively fluidly connect the independent hydraulic system to the at least one other independent hydraulic system. When the valve unit fluidly connects the independent hydraulic system and the at least one other independent hydraulic system, actuating the second driving actuator causes a first flow of fluid to flow from the independent hydraulic system to the at least one other independent hydraulic system.

In an additional aspect, a first connector is in fluid connection with the valve unit and is adapted to fluidly connect the valve unit to the at least one other independent hydraulic system. When the valve unit fluidly connects the independent hydraulic system to the at least one other independent hydraulic system, the first flow enters the at least one other independent hydraulic system via the first connector.

In a further aspect, the at least one other independent hydraulic system has a second connector fluidly connected to the at least one first driven hydraulic actuator, and the first connector is adapted to fluidly connect the valve unit to the at least one other independent hydraulic system via the second connector. When the valve unit fluidly connects the independent hydraulic system to the at least one other independent hydraulic system, the first flow enters the at least one other independent hydraulic system via the first and second connectors.

In an additional aspect, a first connector is in fluid connection with the valve unit and is adapted to fluidly connect the valve unit to the at least one other independent hydraulic system. When the valve unit fluidly connects the independent hydraulic system to the at least one other independent hydraulic system, actuating the second driving actuator causes a second flow of fluid to flow from the at least one other independent hydraulic system to the reservoir via the first connector.

In a further aspect, the at least one other independent hydraulic system has a second connector fluidly connected to the at least one first driven hydraulic actuator, and the first connector is adapted to fluidly connect the valve unit to the at least one other independent hydraulic system via the second connector. When the valve unit fluidly connects the first and second connectors to each other, actuating the second driving actuator causes a second flow of fluid to flow from the at least one other independent hydraulic system to the reservoir via the first and second connectors.

In an additional aspect, the at least one second system used in the operation of the watercraft is a steering system of the watercraft, and comprises a controller connected to the second driving hydraulic actuator for controlling the actuation of the second driving hydraulic actuator, the controller being positioned on the watercraft so as to be operated simultaneously with the steering system by a single operator.

In a further aspect, the watercraft has a propulsion system and the at least one first system used in the operation of the watercraft is one of a tilt system, a trim system and a combined tilt and trim system.

In an additional aspect, the independent hydraulic system further comprises a controller connected to the second driving hydraulic actuator for controlling the actuation of the second driving hydraulic actuator, the controller being positioned on the watercraft so as to be operated by a single operator doing maintenance of the watercraft propulsion system.

In a further aspect, the propulsion system is one of an outboard marine engine and a jet propulsion system.

In an additional aspect, the at least one first system used in the operation of the watercraft is at least one of a combined tilt and trim system, a boat tower, and an actuated rear platform.

In another aspect, a watercraft is provided. The watercraft comprises a first independent hydraulic system for operating at least one first system used in the operation of the watercraft, and a second independent hydraulic system for operating at least one second system used in the operation of the watercraft, the second independent hydraulic system comprising a reservoir, the first and second independent hydraulic systems being adapted to be fluidly connected to each other.

In a further aspect, the first independent hydraulic system comprises a first driving hydraulic actuator for directing fluid flow within the first independent hydraulic system, and at least one first driven hydraulic actuator for operation of the at least one first system used in the operation of the watercraft. The second independent hydraulic system further comprises a second driving hydraulic actuator for directing fluid flow within the second independent hydraulic system, and at least one second driven hydraulic actuator for operation of the at least one second system used in the operation of the watercraft.

In an additional aspect, when the first and second independent hydraulic systems are fluidly connected to each other, actuating the second driving actuator causes a first flow of fluid to flow from the second independent hydraulic system to the first independent hydraulic system.

In a further aspect, the watercraft further comprises a valve unit in fluid connection with the first independent hydraulic system and the second independent hydraulic system, the valve unit selectively fluidly connecting the first independent hydraulic system to the second independent hydraulic system.

In an additional aspect, the at least one first system used in the operation of the watercraft is a steering system of the watercraft.

In a further aspect, the watercraft comprises a controller connected to the second driving hydraulic actuator for controlling the actuation of the second driving hydraulic actuator, and the controller is positioned on the watercraft in proximity to the helm of the watercraft.

In an additional aspect, the watercraft comprises a propulsion system and the at least one second system used in the operation of the watercraft is one of a tilt system, a trim system and a combined tilt and trim system.

In a further aspect, the watercraft further comprises a controller for controlling the actuation of the second driving hydraulic actuator, the controller being positioned on the watercraft such as to be operated by a single operator doing maintenance of the watercraft propulsion system.

In an additional aspect, the propulsion system is one of an outboard marine engine and a jet propulsion system.

In a further aspect, the at least one second system used in the operation of the watercraft is at least one of a combined tilt and trim system, a boat tower, and an actuated rear platform.

For purposes of this application, terms used to locate elements on a watercraft or their spatial orientation, such as "forwardly", "rearwardly", "front", "back", "rear", "left", "right", "up", "down", "above", and "below", are as they would normally be understood by a person operating the watercraft in a forwardly facing, driving position. The term "longitudinal" means extending from the front to the back. The terms "inner", "outer", "proximal" and "distal" are to be understood with regard to the longitudinal centerline of the watercraft.

Embodiments of the present invention each have at least one of the above-mentioned aspects and/or aspects, but not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects and advantages of the embodiments of the present invention will become apparent from the following description, the accompanying drawings and the appended claims.

BRIEF DESCRIPTION OF THE DRAWINGS

For a better understanding of the present invention as well as other aspects and further features thereof, reference is made to the following description which is to be used in conjunction with the accompanying drawings, where.

DETAILED DESCRIPTION

A—First Embodiment

Figure 1:
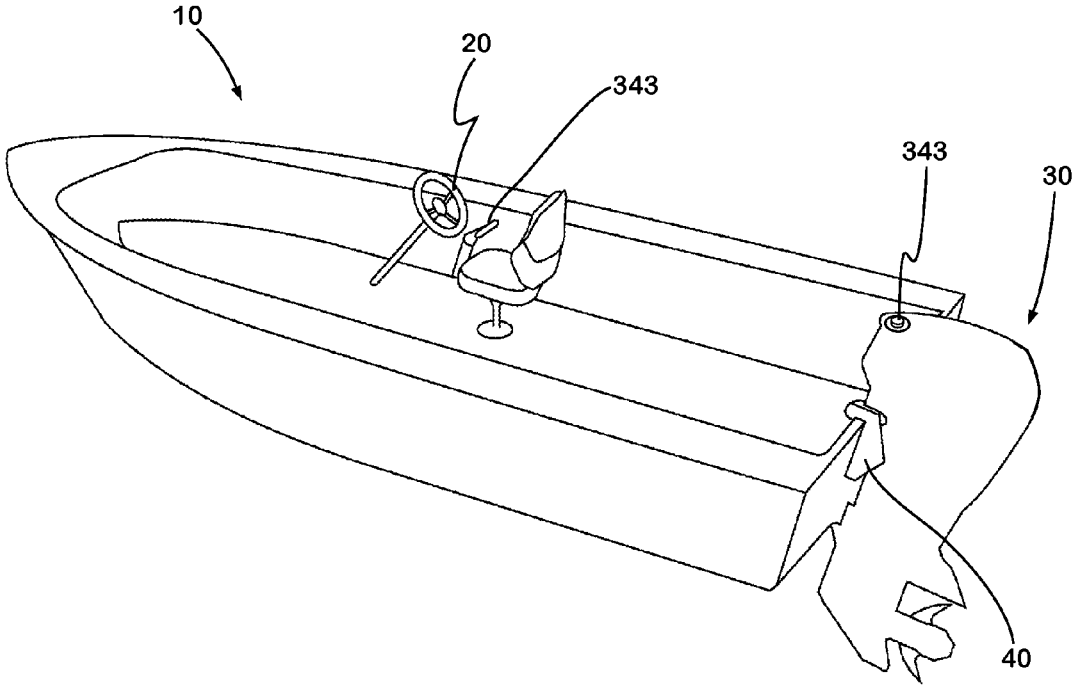
FIG. 1 is a perspective view taken from a rear left side a watercraft.

FIG. 1 is a schematic representation of a watercraft 10 having a steering helm 20 for operating a steering system, and an outboard marine engine 30 mounted to the watercraft 10 via a stern bracket 40 and a tilt/trim system. As will be discussed further below, both the steering system and the tilt/trim system are operated by two independent hydraulic systems 200, 300 (schematically represented in FIGS. 4 to 7 inclusively).

Figure 2:
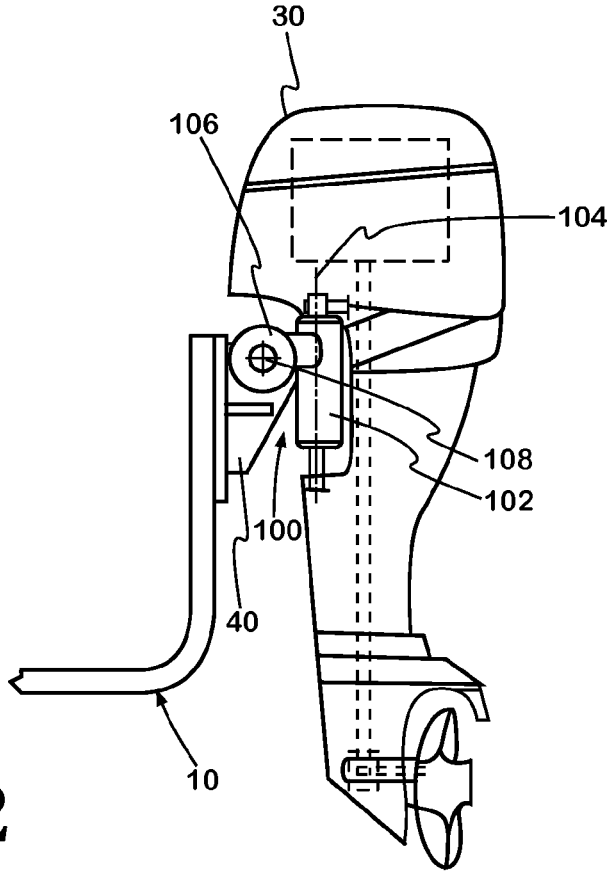
FIG. 2 is a left side elevation view of a outboard marine engine in a tilt down position.
Figure 3:
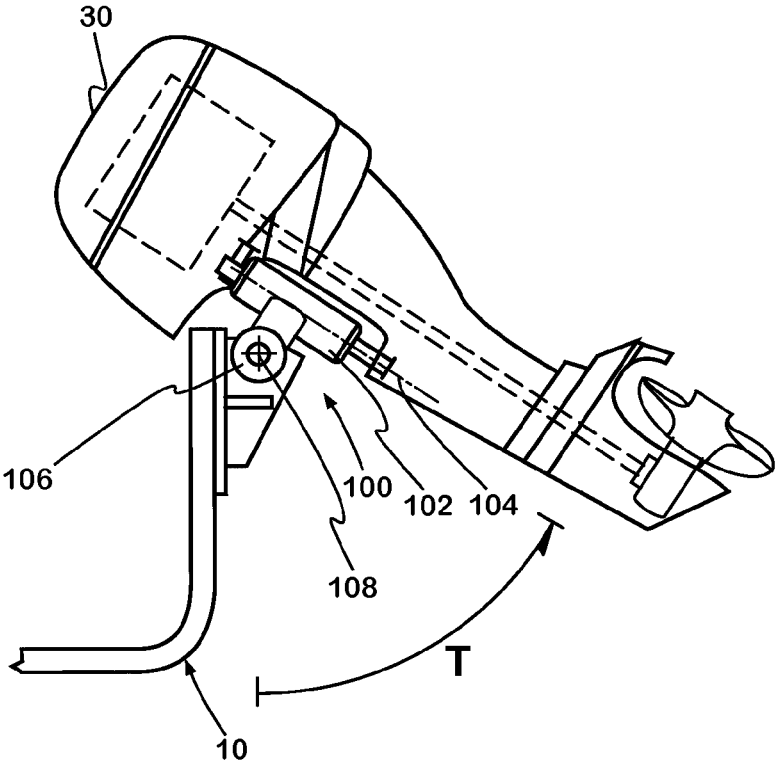
FIG. 3 is a left side elevation view of the outboard marine engine of FIG. 2 tilted upward.

In this embodiment, portions of the steering system and portions of the tilt/trim system (including the steering rotary actuator 102 and the tilt/trim rotary hydraulic actuator 106 shown in FIGS. 2 and 3) are integrated into a single integrated tilt/trim and steering subsystem 100 (shown in FIGS. 2 and 3) such as the one described in U.S. Pat. No. 7,736,206, issued on Jun. 15, 2010, the entirety of which is incorporated herein by reference. However, it is contemplated that other embodiments may use totally independent steering and tilt/trims systems such as those known in the art.

FIGS. 2 and 3 schematically represent portions of the integrated tilt/trim and steering subsystem 100, including the steering rotary hydraulic actuator 102 for pivoting the outboard marine engine 30 about a steering axis 104, and the tilt/trim rotary hydraulic actuator 106 for tilting the outboard marine engine 30 about a tilt/trim axis 108 as illustrated by arrow "T" in FIG. 3. The steering rotary hydraulic actuator 102 has apertures (not shown in FIGS. 2 and 3) and is fluidly connected to the remainder of the first independent hydraulic system 200 through hydraulic conduits, including hydraulic channels and/or hoses (not shown). The tilt/trim rotary hydraulic actuator 106 has apertures (not shown in FIGS. 2 and 3) and is fluidly connected to the remainder of the second independent hydraulic system 300 through hydraulic conduits, including hydraulic channels and/or hoses (not shown in FIGS. 2 and 3). It is also contemplated that the various components of the first and second independent hydraulic systems 200, 300 schematically represented in FIGS. 4 to 7 inclusively, including the hydraulic conduits referred above, can be disposed in various suitable locations of the watercraft 10, including, for many of those components, in the vicinity of the outboard marine engine 30 and stern bracket 40. Components of the first and second independent hydraulic systems 200, 300 can also be part of the integrated tilt/trim and steering subsystem 100 or be attached to it.

Figure 4:
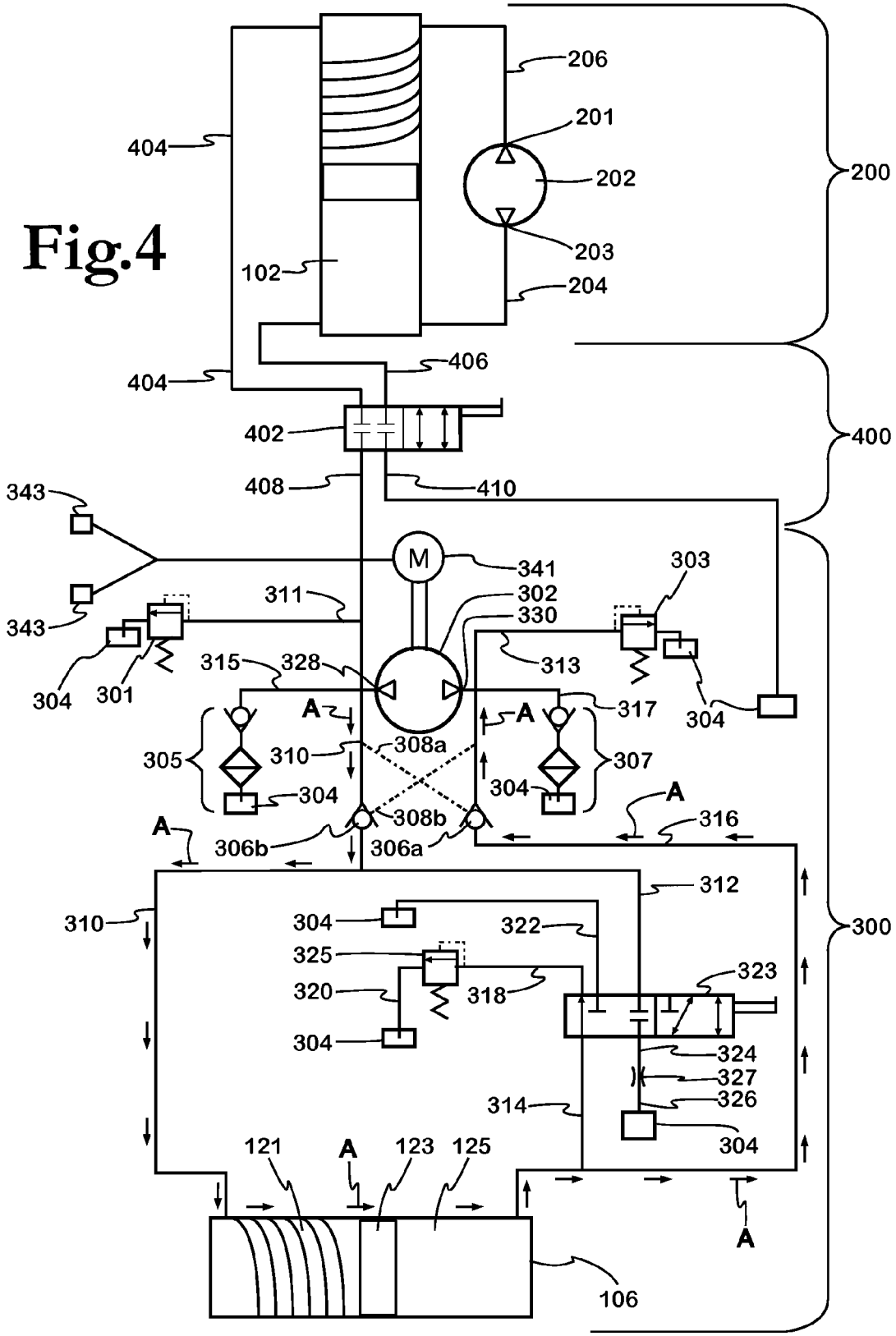
FIG. 4 is a schematic representation of two independent hydraulic systems according a first embodiment showing the "down" flow within the second independent hydraulic system.

FIG. 4 is a schematic illustration of the first independent hydraulic system 200 used to operate the steering rotary hydraulic actuator 102, the second independent hydraulic system 300 used to operate the tilt/trim rotary hydraulic actuator 106, and the flow control subsystem 400 fluidly connecting the first and second independent hydraulic systems 200, 300.

(i) First Independent Hydraulic System 200

The first independent hydraulic system 200 comprises the hydraulic pump 202 having two inlet/outlet ports 201 and 203, the steering rotary hydraulic actuator 102, and conduits 204 and 206 fluidly connecting the hydraulic pump 202 to the steering rotary hydraulic actuator 102. The hydraulic pump 202 is a bidirectional pump. It is contemplated that the hydraulic pump 202 can be any bidirectional pump suitable for this intended use (or, in another embodiment, two suitable unidirectional pumps). For instance, the hydraulic pump 202 can be a manually actuated axial piston pump suitable for drawing up fluid from inlet/outlet port 201 and pushing fluid from inlet/outlet port 203, or drawing up fluid from inlet/outlet port 203 and pushing fluid from inlet/outlet port 201, depending on how the pump is manually operated. It is contemplated that the steering helm 20 can be mechanically connected to the hydraulic pump 202 by any conventional mean capable of transmitting the motion of the steering helm 20 to the hydraulic pump 202 and the flow rate capacity of the hydraulic pump 202 will determine the number of turns of the steering helm 20 required for a lock to lock maneuver of the steering rotary hydraulic actuator 102. It is also contemplated that the hydraulic pump 202 can also be fitted with lock valves (not shown) to prevent inopportune movement of the steering rotary hydraulic actuator 102 when the helm is not operated, and with pressure relief valves (not shown) to protect the first independent hydraulic system 200 against any abnormal pressure increase, considering that such hydraulic system are normally operated at relatively low fluid pressure.

It is contemplated that in normal operation of the steering system to steer the watercraft 10, actuating the hydraulic pump 202 so as to push fluid out from one of inlet/outlet ports 201 and 203 (and correspondingly to draw up fluid to the other one of inlet/outlet ports 201 and 203), will induce the fluid within the first independent hydraulic system 200 to flow in one direction or the other, and will cause a corresponding actuation of the steering rotary hydraulic actuator 102, such as to pivot the outboard marine engine 30 about the steering axis 104.

(ii) Second Independent Hydraulic System 300

The second independent hydraulic system 300 comprises the hydraulic pump 302, the tilt/trim rotary hydraulic actuator 106, two pressure relief valves 301 and 303, a reservoir 304 (schematically represented by a plurality of reservoirs but consisting in fact of a single reservoir), two check valves and filter/strainer assemblies 305 and 307, two check valves 306(*a*) and 306(*b*), two pilot lines 308(*a*) and 308(*b*), a valve unit 323, a pressure relief valve 325, and a flow restriction 327.

Conduits 310, 312 fluidly connect the hydraulic pump 302 to the tilt/trim rotary hydraulic actuator 106 and the valve unit 323. Conduits 314, 316 fluidly connect the tilt/trim rotary hydraulic actuator 106 to the valve unit 323 and the hydraulic pump 302. Conduits 311, 313 fluidly connect the hydraulic pump 302 to the pressure relief valves 301 and 303 respectively. Conduits 315, 317 fluidly connect the hydraulic pump 302 to the two check valves and filter/strainer assemblies 305, 307.

Conduits 318, 320 fluidly connect the valve unit 323 to the pressure relief valve 325 and the pressure relief valve 325 to the reservoir 304. Conduit 322 fluidly connects the valve unit 323 to the reservoir 304. Conduits 324, 326 fluidly connect the valve unit 323 to the flow restriction 327, and the flow restriction 327 to the reservoir 304.

The hydraulic pump 302 is a bidirectional pump having two inlet/outlet ports 328, 330. It is contemplated that the hydraulic pump 302 can be any bidirectional pump suitable for this intended use (or, in another embodiment, two suitable unidirectional pumps), various tilt/trim systems known in the art using various know models of such bidirectional pumps depending on the particular needs of every particular tilt/trim system considering the particular type of outboard marine engine two which it is coupled.

The hydraulic pump 302 is actuated by the electric motor 341 and it is contemplated that the electric motor 341 can be any electric motor suitable for this intended use, hydraulic pumps such as the hydraulic pump 302 being generally sold in an assembly comprising a suitable electric motor. The electric motor 341 is activated by the two controllers 343, one of which is disposed in the vicinity of the steering helm 20 (see FIG. 1) such that this one controller 343 can be operated by a single operator simultaneously with the steering helm 20. The other controller 343 is disposed in the vicinity of the outboard marine engine 30, in this embodiment, on the cowling of the outboard marine engine 30, such that a single person doing maintenance of the outboard marine engine 30 can operate controller 343.

Pressure relief valve 301 is set to fluidly connect the second independent hydraulic system 300 to the reservoir when fluid pressure within conduit 311 reaches 600 psi. Pressure relief valve 303 is set to fluidly connect the second independent hydraulic system 300 to the reservoir when fluid pressure within conduit 313 reaches 2000 psi. It is contemplated that in other embodiments, pressure relief valves 301 and 303 may be set to be triggered when pressure within the relevant conduits reaches other pressure thresholds considering the particularity and operation conditions of various hydraulic systems used to operate various systems on the watercraft.

Check valves and filter/strainer assemblies 305 and 307 serves to draw up fluid from the reservoir within the second independent hydraulic system 300 when fluid pressure in the vicinity of one of the inlet/outlet ports 328, 330 of the hydraulic pump 302 decreases in order to ensure that the hydraulic pump 302 and the second independent hydraulic system 300 operates with an appropriate volume of fluid.

Each check valves 306(*a*), 306(*b*) is fluidly connected to one of conduits 310 and 316 as well as to the other one of conduits 310 and 316 via pilot lines 308(*a*), 308(*b*). As discussed further below, when the hydraulic pump 302 is actuated, both check valves 306(*a*), 306(*b*) allow the flow of fluid within the second independent hydraulic system 300. However, when the hydraulic pump 302 is not actuated, the check valves 306(*a*), 306(*b*) inhibit the flow of fluid within the second independent hydraulic system 300 and the tilt/trim rotary hydraulic actuator 106 cannot be actuated (and the outboard marine engine 30 be tilted about the tilt/trim axis 108) by other means, such as by applying force directly to the outboard marine engine 30.

Pressure relief valve 325 is set to fluidly connect the second independent hydraulic system 300 to the reservoir 304 when fluid pressure within conduit 314 reaches 2200 psi. Again, it is contemplated that in other embodiments, the pressure relief valve 325 may be set to be triggered when pressure within conduit 314 reaches another pressure threshold considering the particularity and operation conditions of various hydraulic systems used to operate various systems on the watercraft.

Figure 7:
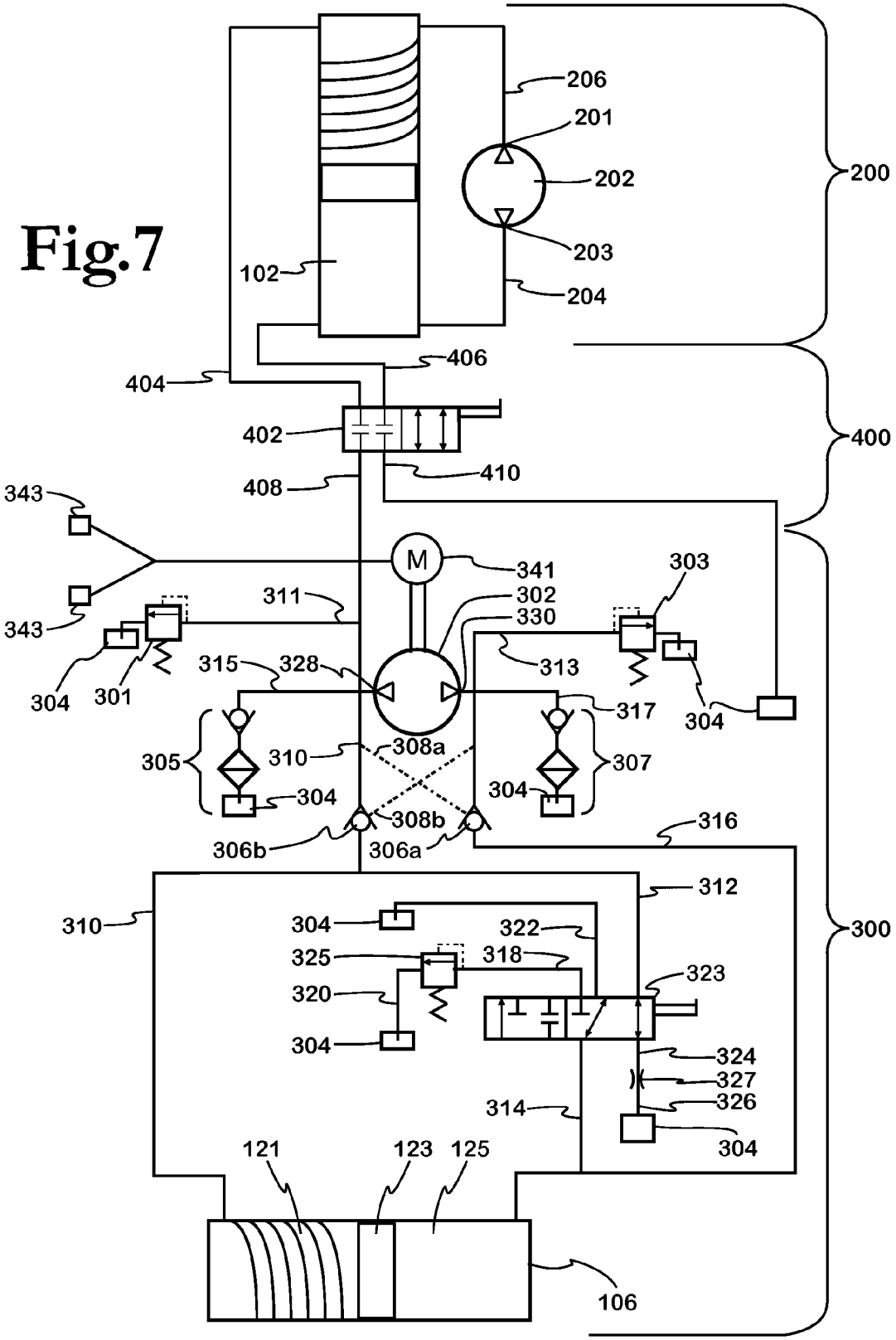
FIG. 7 is a schematic representation of the two independent hydraulic systems of FIG. 4 showing a valve unit set to a position for maintenance of the watercraft.

Flow restriction 327 is used to restrict the volume of fluid that can flow from conduit 312 to the reservoir 304 when the valve unit 323 is set so as to allow such fluid flow (discussed below regarding FIG. 7).

Valve unit 323 is a manually operated, two-position, two connections valves. In a first position (shown in FIGS. 4, 5 and 6), the valve unit 323 fluidly disconnects the inlet/outlet port 328 of the hydraulic pump 302 and the tilt/trim rotary hydraulic actuator 106, from the flow restriction 327 (and therefore from the reservoir 304). In this first position, the valve unit 323 allows fluid connection between the inlet/outlet port 330 and the pressure relief valve 325 and between the tilt/trim rotary hydraulic actuator 106 and the pressure relief valve 325. In normal use of the integrated tilt/trim and steering subsystem 100, the valve unit 323 is set to this first position.

In a second position (shown in FIG. 7), the valve unit 323 allows fluid connection between the tilt/trim rotary hydraulic actuator 106, and the reservoir 304 (through the flow restriction 327). In this second position, the valve unit 323 also allows a direct fluid connection between the tilt/trim rotary hydraulic actuator 106, and the reservoir 304 (via conduits 314, 322).

The valve unit 323 is set to this second position for maintenance purposes when the watercraft is not in use. When the valve unit 323 is set to this second position, the second independent hydraulic system 300 is unlocked and the outboard marine engine 30 may be manually pivoted about the tilt/trim axis 108 without actuation of the hydraulic pump 302.

In normal use condition of the watercraft 10, to operate the tilt/trim system to pivot the outboard marine engine 30 about the tilt/trim axis 108, the hydraulic pump 302 is actuated (through controllers 343 and the electric motor 341) so as to push fluid out of the inlet/outlet 328 and draw up fluid in the inlet/outlet 330 or, conversely to draw up fluid in the inlet/outlet 328 and to push fluid out of the inlet/outlet 330. When fluid is pushed out of the inlet/outlet 328, the fluid within the second independent hydraulic system 300 is induced to flow in the direction illustrated by arrows "A" in FIG. 4 (the "down flow") and causes the tilt/trim rotary hydraulic actuator 106 to rotate such as to pivot the outboard marine engine 30 toward the watercraft 10 in a "down" position. At the end of the tilt/trim rotary hydraulic actuator 106 range of motion in the "down" direction, the propeller of the outboard marine engine 30 is fully immerged and as close to the watercraft as it can get.

The fluid flowing through conduits 310 does not flow through the tilt/trim rotary hydraulic actuator 106, but fluid flowing from conduit 310 into the first chamber 121 pushes the piston 123 within the tilt/trim rotary hydraulic actuator 106, and the piston 123 pushes the fluid within the second chamber 125 outside the tilt/trim rotary hydraulic actuator 106 through conduit 316, thereby inducing the fluid within the conduit 316 to flow in the direction illustrated by arrows "A" in FIG. 4. When the fluid flows within the second independent hydraulic system 300 according to this "down flow", the fluid pushed out of the inlet/outlet 328 enter the pilot line 308(*a*) and the check valve 306(*a*) is actuated so as to let fluid flow through conduit 316 up to the inlet/outlet 330. Actuating the tilt/trim rotary hydraulic actuator 106 in this "down" direction may increase fluid pressure within conduits 310, 312, 315 and 311, but the pressure relief valve 301 will ensure that such fluid pressure does not increase above 600 psi in the vicinity of the inlet/outlet 328 of the hydraulic pump 302.

Figure 5:
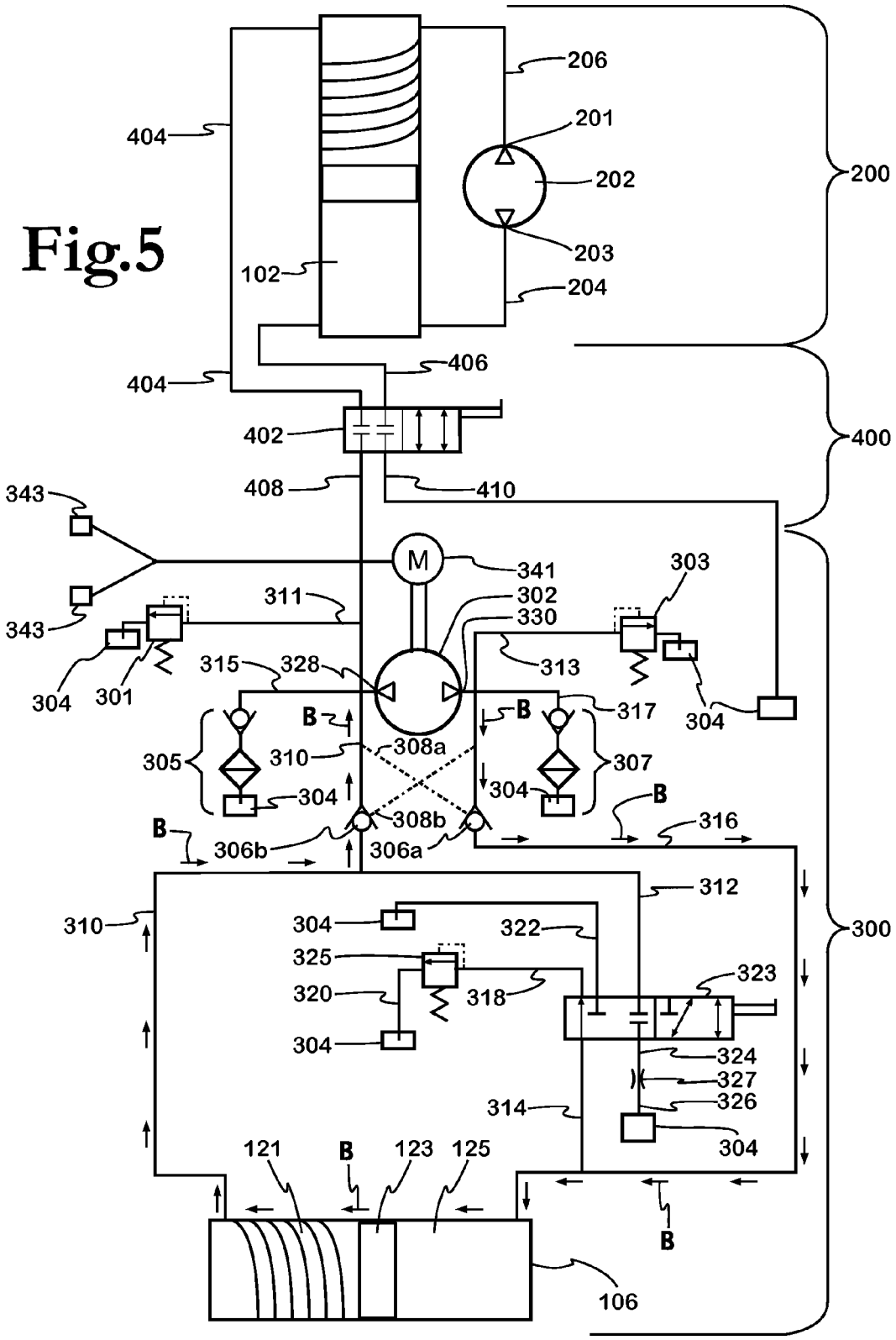
FIG. 5 is a schematic representation of the two independent hydraulic systems of FIG. 4 showing the "up" flow within the second independent hydraulic system.
Figure 6:
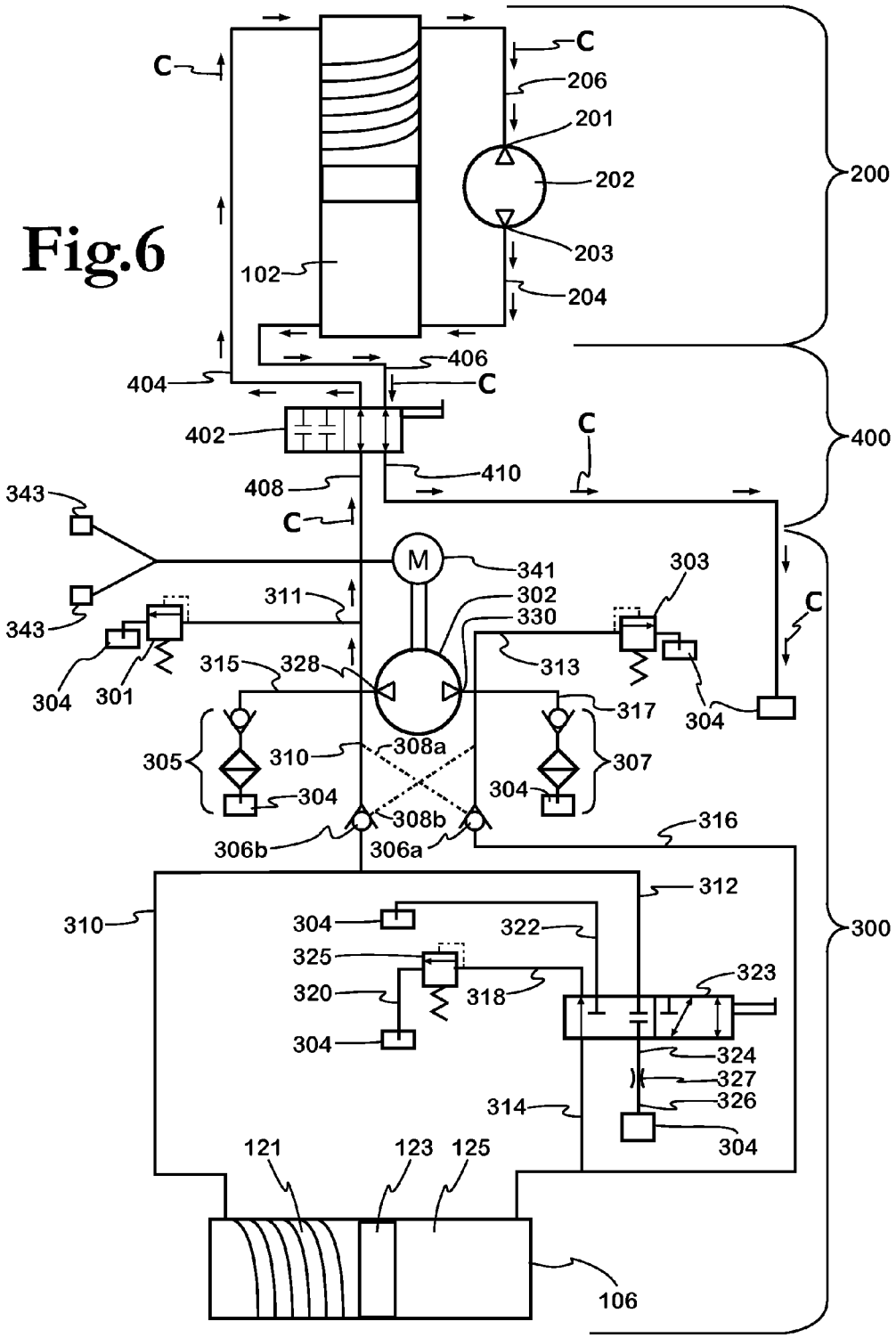
FIG. 6 is a schematic representation of the two independent hydraulic systems of FIG. 4 showing the "fill/bleed/purge" flow within the first independent hydraulic system.

Conversely, when the hydraulic pump 302 is actuated so as to push fluid out of the inlet/outlet 330 and draw up fluid in the inlet/outlet 328, the fluid within the second independent hydraulic system 300 is induced to flow as illustrated by arrows "B" in FIG. 5 (the "up flow") and causes the tilt/trim rotary hydraulic actuator 106 to rotate such as to pivot the outboard marine engine 30 away from the watercraft 10 in an "up" position wherein the propeller of the outboard marine engine 30 is pushed out of the water. At the end of the tilt/trim rotary hydraulic actuator 106 range of motion in the "up" direction, the propelling mean of the outboard marine engine 30 is pushed out of the water and as far away as allowed by the tilt/trim range of motion.

As discussed above regarding the "down" flow, fluid within the tilt/trim rotary hydraulic actuator 106 does not flow through the tilt/trim rotary hydraulic actuator 106 but the fluid forced within the second chamber 125 through conduit 316 pushes on the piston 123, which in turn forces the fluid within the first chamber 121 out of the tilt/trim rotary hydraulic actuator 106 through conduit 310, thereby inducing the fluid within conduit 310 to flow in the direction illustrated by arrows "B" in FIG. 5. When the fluid flows within the second independent hydraulic system 300 according to this "up flow", the fluid pushed out of the inlet/outlet 330 enter the pilot line 308(*b*) and the check valve 306(*b*) is actuated so as to let fluid flow through conduit 310 up to the inlet/outlet 328. Actuating the tilt/trim rotary hydraulic actuator 106 in this "up" direction may increase fluid pressure within conduits 314, 316, 317 and 313, but pressure relief valve 303 will ensure that such fluid pressure does not raise above 2000 psi in the vicinity of the inlet/outlet 328 of the hydraulic pump 302 and pressure relief valve 325 will ensure that such pressure does not increase above 2200 psi in the vicinity of the tilt/trim rotary hydraulic actuator 106.

(iii) Flow Control Subsystem 400

The flow control subsystem 400 comprises a valve unit 402 and conduits 404, 406, 408 and 410. The valve unit 402 is a two-position, two connections valve. The valve unit 402 is fluidly connected to the first independent hydraulic system 200 through conduits 404 and 406 and to the second independent hydraulic system 300 through conduits 408 and 410. As shown in FIGS. 4, 5, 6 and 7 conduit 410 is directly connected to the reservoir 304 of the second independent hydraulic system 300. It is contemplated that the conduit 410 could connect to the reservoir 304 via other components.

In a first position (shown in FIGS. 4, 5 and 7), the valve unit 402 inhibits any fluid connection between the first and second independent hydraulic systems 200, 300. The first and second independent hydraulic system 200, 300 therefore operate independently from each other as would be the case when the watercraft is in operation.

In a second position (shown in FIG. 6), the valve unit 402 allows fluid connection between conduits 404 and 408, and between conduits 406 and 410, thereby fluidly connecting the first and second independent hydraulic systems 200, 300. The valve unit 402 is to be set to this second position for maintenance purposes when the watercraft is not in operation.

It is contemplated that both the first and second independent hydraulic systems 200, 300 operate with the same or compatible hydraulic fluids.

(iv) Filling, Bleeding or Purging the First Independent System 200 Using the Second Independent System 300

When the first and second independent hydraulic systems 200, 300 are fluidly connected to each other through the flow control subsystem 400, the second independent hydraulic system 300 may be used to perform maintenance of the first independent hydraulic system 200 by either filling the first independent hydraulic system 200 with new fluid, bleeding the first independent hydraulic system 200 from fluid already in the first independent hydraulic system 200, and then filling the first independent hydraulic system 200 with new fluid, and/or purging gas from the first independent hydraulic system 200. To do this, once the valve unit 402 is set to its second position (fluidly connecting both independent hydraulic systems 200, 300), the hydraulic pump 302 is actuated (through controllers 343 and the electric motor 341) so as to induce the fluid within the second independent hydraulic system 300 to follow the "down flow". Since the fluid pressure required to actuate the tilt/trim rotary hydraulic actuator 106 is greater than the fluid pressure within the first independent hydraulic system 200 when the first independent hydraulic system 200 is in normal operation condition (especially when the tilt/trim rotary hydraulic actuator 106 has reached the end of its range of motion in the "down" direction), fluid pushed within the second independent hydraulic system 300 though the inlet/outlet 328 of the hydraulic pump 302 (and drawn up from the reservoir 304 through the check valves and filter/strainer assemblies 307) enters conduits 408, 404 and the fluid within the first independent hydraulic system 200 is induced to flow as illustrated by arrows "C" in FIG. 5 (the "fill/bleed/purge flow").

In an alternative embodiment where the fluid pressure within the first independent hydraulic system 200 when the first independent hydraulic system 200 is in normal operation condition is not greater than the fluid pressure required to actuate the tilt/trim rotary hydraulic actuator 106 (either for the whole range of motion of the tilt/trim rotary hydraulic actuator 106 or for a part thereof), the tilt/trim rotary hydraulic actuator 106 will be actuated until it reaches the end of its range of motion in the "down" direction or before then until the fluid pressure required to pivot the outboard marine engine 30 further down will be greater than the fluid pressure within the first independent hydraulic system 200.

Once fluid from the second independent hydraulic system 300 is forced into the first independent hydraulic system 200, fluid pressure within the first independent hydraulic system 200 will increase but pressure relief valve 301 will ensure that fluid pressure in conduit 311 will not rise above 600 psi. In an alternative embodiment, a pressure relief valve (not shown) can also be fluidly connected to conduits 404, 406 so as to create a bypass flow to avoid fluid pressure to get too high within the first independent hydraulic system 200. The fill/bleed/purge flow induced to the fluid within the first independent hydraulic system 200 and the increased fluid pressure will allow the evacuation of gas within the first independent hydraulic system 200 toward the reservoir 304, the evacuation (or bleeding) of "old" fluid toward the reservoir, and the complete filling of the first independent hydraulic system 200 with fluid.

By manually actuating the steering rotary hydraulic actuator 202 toward its entire range of motion (by steering the steering helm 20) while actuating the tilt/trim rotary hydraulic actuator 106 so as to tilt/trim down the outboard marine engine 30, an operator performing maintenance of the watercraft will more efficiently bleed and fill the first independent hydraulic system 200 with fluid, and purge gas from the first independent hydraulic system 200.

B—Other Embodiments

Figure 8:
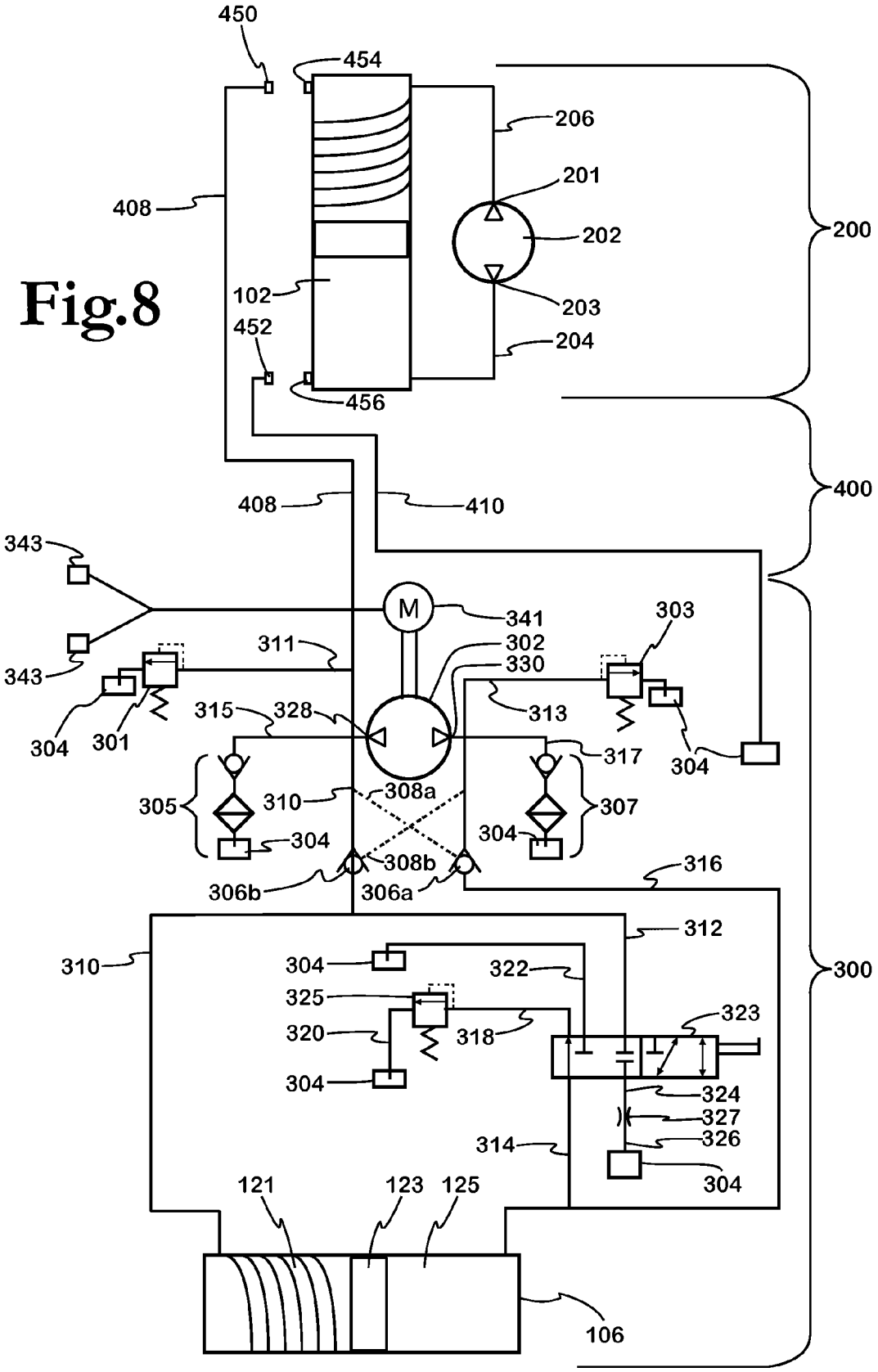
FIG. 8 is a schematic representation of the two independent hydraulic systems according to another embodiment.

In another embodiment shown in FIG. 8, the valve unit 402 is omitted, all the other elements discussed regarding the first embodiment shown in FIGS. 4 to 7 being the same. Connectors 450, 452 are fluidly connected to conduits 408 and 410. Connectors 450 and 452 are adapted for fluid connection with apertures 454, 456 (or, when needed, to corresponding connectors fluidly connected to apertures 454, 456, not shown) of the steering rotary hydraulic actuator 102 when the second independent hydraulic systems 300 is used to fill, bleed and/or purge the first independent hydraulic system 200 as discussed regarding the first embodiment shown in FIGS. 4 to 7.

It is contemplated that in other embodiments (not shown), apertures 454, 456 can be disposed at any suitable location within the first independent hydraulic system 200 including, for at least one of the two apertures 454, 456, within the structure of the steering helm.

Figure 9:
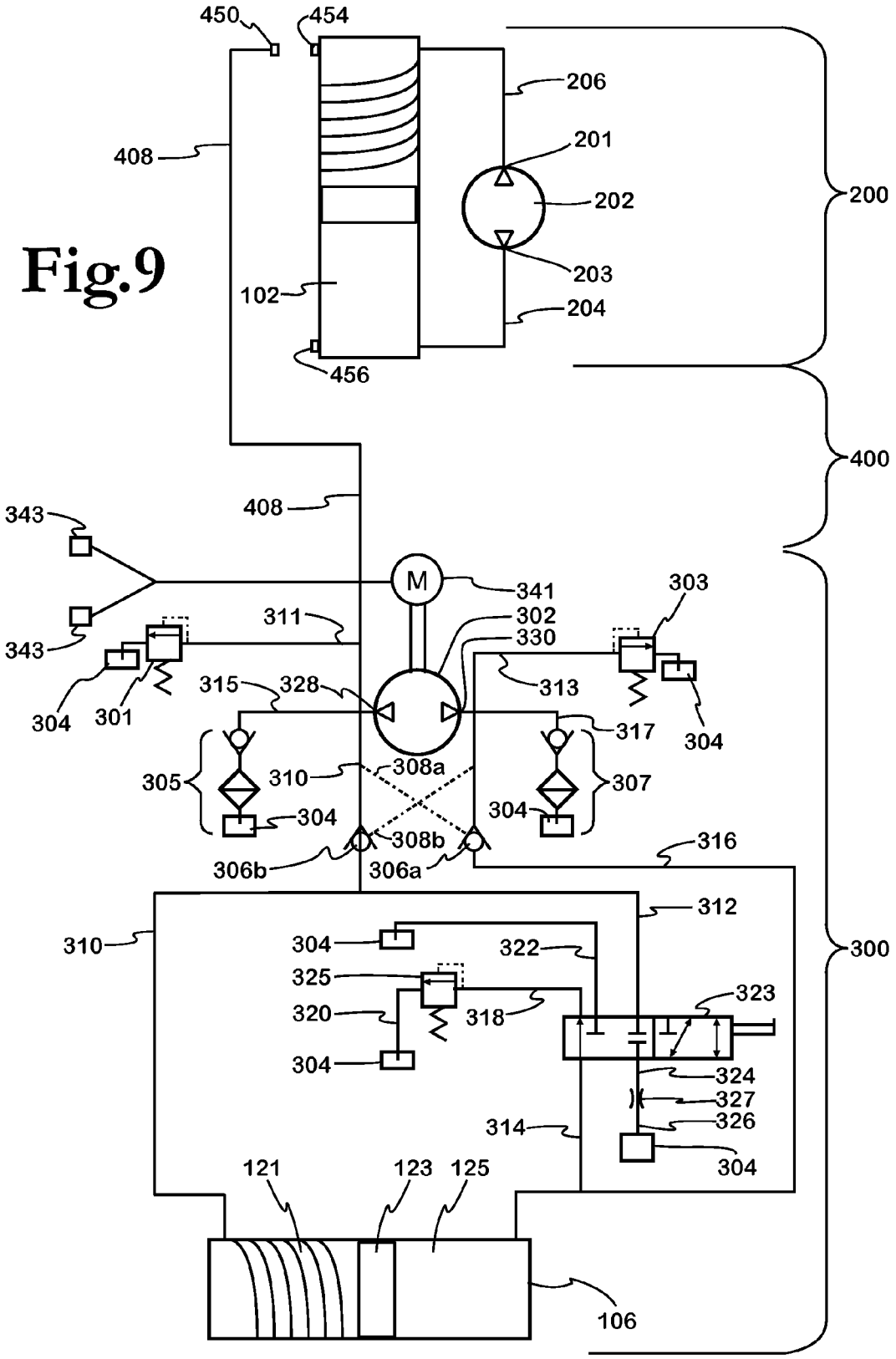
FIG. 9 is a schematic representation of the two independent hydraulic systems according to another embodiment.

In another embodiment shown in FIG. 9, there is no conduit 410 for fluidly connecting the first independent hydraulic system 200 to the reservoir 304 (all the other elements of the embodiment shown in FIG. 8 being the same). In this embodiment, bleeding and purging of the first independent hydraulic system 200 is done directly through the aperture 456 either through a reservoir (not shown) of the first independent hydraulic system 200 or a hose (not shown) discharging the fluid flowing from the aperture 456 within a suitable container (not shown). It is contemplated that in other embodiments, apertures 454, 456 can by disposed at any suitable location within the first independent hydraulic system 200, including, for at least one of the two apertures 454, 456, within the structure of the steering helm.

Figure 10:
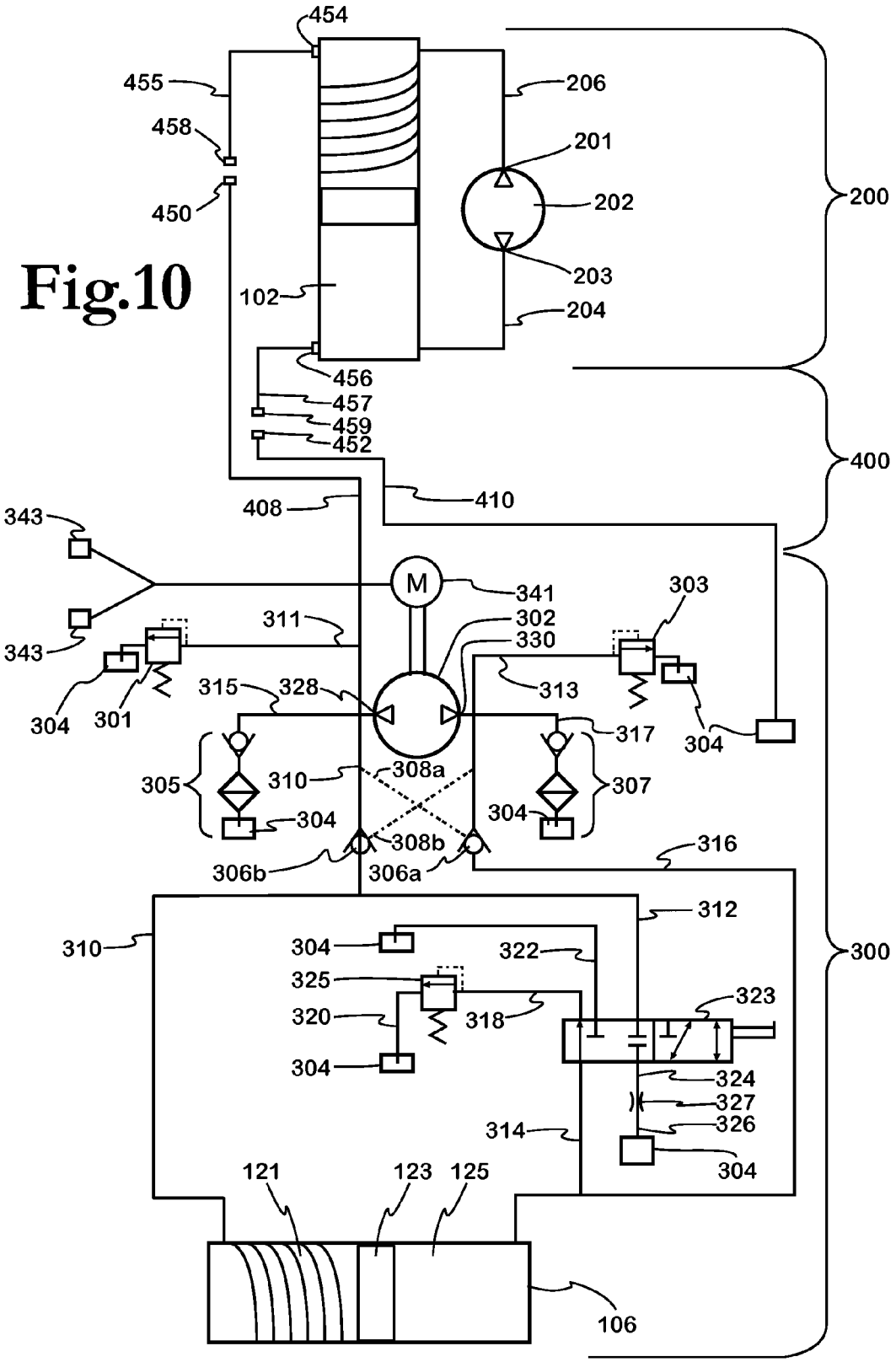
FIG. 10 is a schematic representation of the two independent hydraulic systems according to another embodiment.

Another embodiment shown in FIG. 10 includes all the elements of the embodiment shown in FIG. 8 and further includes additional conduits 455, 457 which fluidly connect apertures 454, 456 to the additional connectors 458, 459, and connectors 450, 452 are adapted for fluid connection with connectors 458, 459. In another embodiment (not shown), there is no conduit 410 and bleeding and purging of the first independent hydraulic system 200 is done directly through the aperture 456 as in the embodiment shown in FIG. 9.

Figure 11:
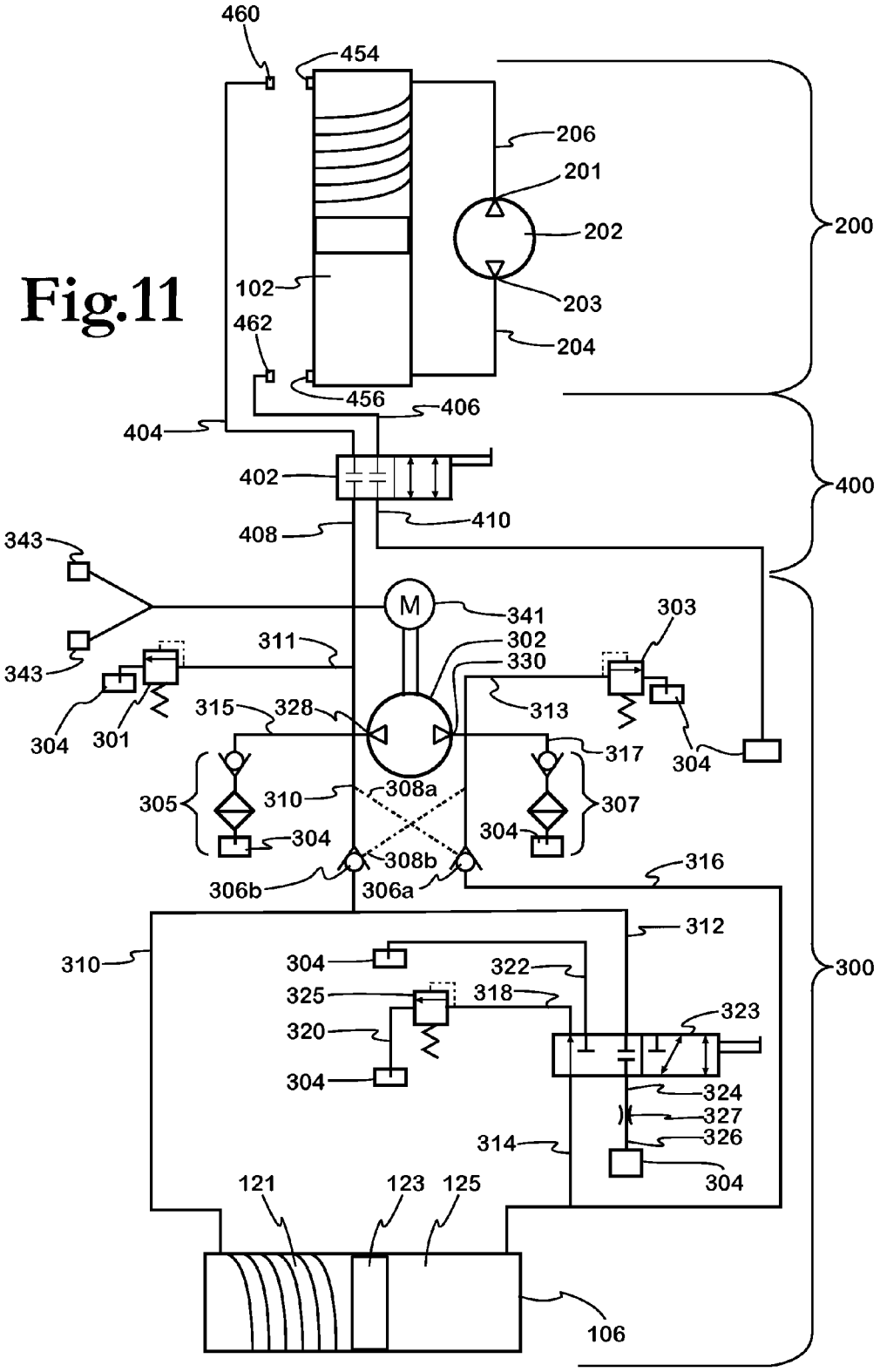
FIG. 11 is a schematic representation of the two independent hydraulic systems according to another embodiment.

In another embodiment shown in FIG. 11, the only difference with the first embodiment shown in FIGS. 4 to 7 it that the valve unit 402 is not permanently connected to the first independent hydraulic system 200. Connectors 460, 462 are fluidly connected to conduits 404, 406. Connectors 460, 462 are adapted for fluid connection with apertures 454 and 456 (or, when needed, to corresponding connectors fluidly connected to apertures 454, 456, not shown) of the steering rotary hydraulic actuator 102. It is contemplated that in other embodiments, apertures 454, 456 can be disposed at any suitable location within the first independent hydraulic system 200 including, at least for one of the two apertures 454, 456, within the structure of the steering helm. In other embodiments (not shown), apertures 454, 456 may also be connected to conduits and connectors (such as conduits 455, 457 and connectors 458, 459 in FIG. 10) to which connectors 460, 462 are adapted to be fluidly connected. To fill, bleed or purge the first independent hydraulic system 200, connectors 460, 462 are connected to apertures 454, 456 (or to the appropriate connectors fluidly connected to apertures 454,456 depending on the embodiment), the valve unit 402 is set so as to fluidly connect the first and second independent hydraulic systems 200, 300, and the hydraulic pump 302 is actuated as in the first embodiment shown in FIGS. 4 to 7.

Figure 12:
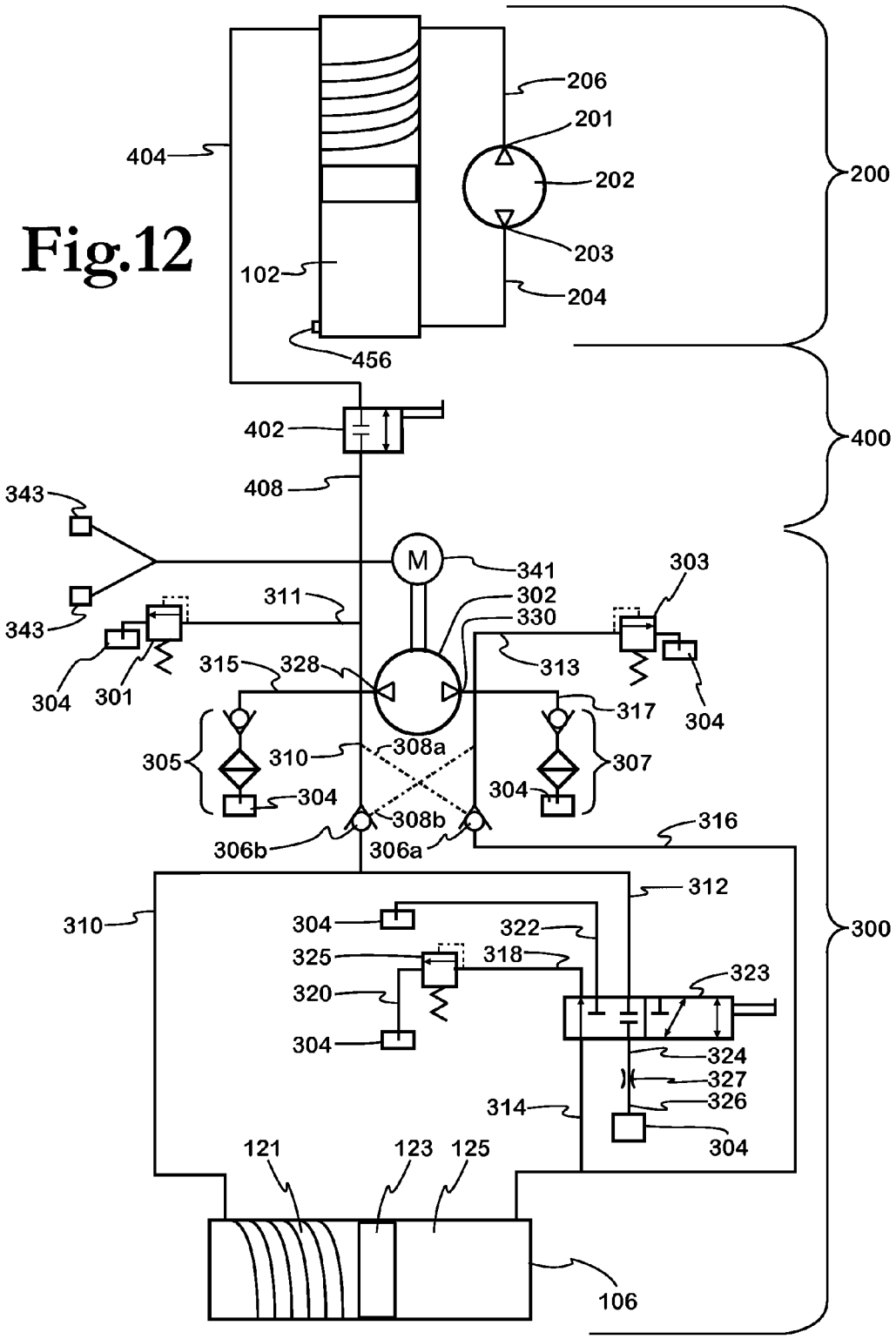
FIG. 12 is a schematic representation of the two independent hydraulic systems according to another embodiment.

In yet another embodiment shown in FIG. 12, the main difference with the first embodiment shown in FIGS. 4 to 7 is that the valve unit 402 is a two-position one connection valve and there is no possible fluid connection between the first independent hydraulic system 200 and the reservoir 304. As in the embodiment shown in FIG. 9, in this embodiment, bleeding and purging of the first independent hydraulic system 200 is done directly through the apertures 456. It is contemplated that in other embodiments, aperture 456 can be disposed at any suitable location within the first independent hydraulic system 200.

It is contemplated that in the various embodiments described above, the connectors 450, 452, 458, 459, 460, 462 may be any type of connectors adapted to fluidly connect conduits 408, 410 to apertures 454, 456 or to connectors 458, 459, such as threaded ends of the conduits 408, 410, 450, 452, 458, 459, threaded fittings connected to the conduits 408, 410, 450, 452, 458, 459, quick connect connectors connected to the conduit 408, 410, 450, 452, 458, 459, or any other suitable such connector for fluid connection connected to the conduits 408, 410, 450, 452, 458, 459 and, when needed, to the apertures 454, 456.

The various embodiments described above involve two hydraulic systems used to operate both the steering system and the tilt/trim system of the watercraft. However, it is contemplated that the first and second independent hydraulic systems 200, 300 could also be any onboard hydraulic system used in the operation of the watercraft, or in the operation of any device attached thereto or used thereon such as boat towers and various movable platforms like boarding bridges and platforms found at the rear of large yacht and used to get small watercraft such as personal watercraft out of the water when they are not used.

Modifications and improvement to the above described embodiments may become apparent to those skilled in the art. The foregoing description is intended to be exemplary rather than limiting. Furthermore, the dimensions of features of various components that may appear on the drawings are not meant to be limiting, and the size of the components therein can vary from the size that may be portrayed in the figures herein. The scope of the present invention is therefore intended to be limited solely by the scope of the appended claims.

What is claimed is:

1. An assembly of hydraulic systems comprising:

a hydraulic system for operating at least one first system used in the operation of a watercraft;

at least one other hydraulic system for operating at least one second system used in the operation of the watercraft, the at least one other hydraulic system comprising:

a first driving hydraulic actuator for directing fluid flow within the at least one other hydraulic system; and at least one first driven hydraulic actuator for operation of the at least one second system used in the operation of the watercraft;

the hydraulic system comprising:

a reservoir;

a second driving hydraulic actuator fluidly connected to the reservoir for directing fluid flow within the hydraulic system; and at least one second driven hydraulic actuator fluidly connected to the second driving hydraulic actuator for operation of the at least one first system used in the operation of the watercraft; and a valve unit fluidly connected to the second driving hydraulic actuator and selectively fluidly connecting the hydraulic system to the at least one other hydraulic system, the valve unit having a first and a second position, in the first position of the valve unit, the valve unit inhibiting any fluid connection between the hydraulic system and the at least one other hydraulic system, in the second position of the valve unit, the valve unit fluidly connecting the hydraulic system to the at least one other hydraulic system and actuating the second driving actuator causing a first flow of fluid to flow from the hydraulic system to the at least one other hydraulic system.

2. The assembly of hydraulic systems of claim 1, further comprising:

a first connector in fluid connection with the second driving hydraulic actuator and adapted to fluidly connect the hydraulic system to the at least one other hydraulic system;

wherein when the hydraulic system and the at least one other hydraulic system are fluidly connected to each other, the first flow enters the at least one other hydraulic system via the first connector.

3. The assembly of hydraulic systems of claim 1, further comprising:

a first connector in fluid connection with the reservoir and adapted to fluidly connect the reservoir to the at least one other hydraulic system;

wherein when the hydraulic system and the at least one other hydraulic system are fluidly connected to each other, actuating the second driving actuator causes a second flow of fluid to flow from the at least one other hydraulic system to the reservoir via the first connector.

4. The assembly of hydraulic systems of claim 2, wherein the at least one other hydraulic system has a second connector fluidly connected to the at least one first driven hydraulic actuator, wherein:

the first connector is adapted to fluidly connect the hydraulic system to the at least one other hydraulic system via the second connector; and when the hydraulic system and the at least one other hydraulic system are fluidly connected to each other via the fluid connection of the first and second connectors, the first flow enters the at least one other hydraulic system via the first and second connectors.

5. The assembly of hydraulic systems of claim 3, wherein the at least one other hydraulic system has a second connector fluidly connected to the at least one first driven hydraulic actuator, wherein:

the first connector is adapted to fluidly connect the hydraulic system to the at least one other hydraulic system via the second connector;

when the first and second connectors are fluidly connected to each other, actuating the second driving actuator causes a second flow of fluid to flow from the at least one other hydraulic system to the reservoir via the first and second connectors.

6. The assembly of hydraulic systems of claim 1, wherein the at least one second system used in the operation of the watercraft is a steering system of the watercraft, and further comprising:

a controller connected to the second driving hydraulic actuator for controlling the actuation of the second driving hydraulic actuator;

the controller being positioned on the watercraft so as to be operated simultaneously with the steering system by a single operator.

7. The assembly of hydraulic systems of claim 1, wherein:

the watercraft has a propulsion system and the at least one first system used in the operation of the watercraft is at least one of a tilt system, a trim system, a combined tilt and trim system, a boat tower, and an actuated rear platform; and the propulsion system is one of an outboard marine engine and a jet propulsion system.

8. The assembly of hydraulic systems of claim 7, further comprising:

a controller connected to the second driving hydraulic actuator for controlling the actuation of the second driving hydraulic actuator;

the controller being positioned on the watercraft so as to be operated by a single operator doing maintenance of the watercraft propulsion system.

9. A watercraft comprising:

a hull;

a propulsion system connected to the hull;

a helm operatively connected to the propulsion system;

a hydraulic system for operating at least one first system used in the operation of the watercraft;

at least one other hydraulic system for operating at least one second system used in the operation of the watercraft, the at least one other hydraulic system comprising:

a first driving hydraulic actuator for directing fluid flow within the at least one other hydraulic system; and at least one first driven hydraulic actuator for operation of the at least one second system used in the operation of the watercraft;

the hydraulic system comprising:

a reservoir;

a second driving hydraulic actuator fluidly connected to the reservoir for directing fluid flow within the hydraulic system; and at least one second driven hydraulic actuator fluidly connected to the second driving hydraulic actuator for operation of the at least one first system used in the operation of the watercraft; and a valve unit fluidly connected to the second driving hydraulic actuator and selectively fluidly connecting the hydraulic system to the at least one other hydraulic system, the valve unit having a first and a second position, in the first position of the valve unit, the valve unit inhibiting any fluid connection between the hydraulic system and the at least one other hydraulic system, in the second position of the valve unit, the valve unit fluidly connecting the hydraulic system to the at least one other hydraulic system and actuating the second driving actuator causing a first flow of fluid to flow from the hydraulic system to the at least one other hydraulic system.

10. The watercraft of claim 9, wherein the at least one second system used in the operation of the watercraft is a steering system of the watercraft, the watercraft further comprising:

a controller connected to the second driving hydraulic actuator for controlling the actuation of the second driving hydraulic actuator, the controller being positioned on the watercraft in proximity to the helm of the watercraft.

11. The watercraft of claim 9, wherein the at least one first system used in the operation of the watercraft is at least one of a tilt system, a trim system, a combined tilt and trim system a boat tower, and an actuated rear platform; and wherein the propulsion system is one of an outboard marine engine and a jet propulsion system.

12. The watercraft of claim 11, further comprising:

a controller for controlling the actuation of the second driving hydraulic actuator;

the controller being positioned on the watercraft such as to be operated by a single operator doing maintenance of the watercraft propulsion system.

* * * * *

UNITED STATES PATENT AND TRADEMARK OFFICE

CERTIFICATE OF CORRECTION

PATENT NO. : 8,840,438 B2
APPLICATION NO. : 13/333108
DATED : September 23, 2014
INVENTOR(S) : George Broughton et al.

It is certified that error appears in the above-identified patent and that said Letters Patent is hereby corrected as shown below:

In the Claims

Claim 11, Column 16, line 54, "and trim system a" should read -- and trim system, a --.

Signed and Sealed this
Twenty-seventh Day of January, 2015

Michelle K. Lee

Michelle K. Lee
*Deputy Director of the United States Patent and Trademark Office*